US006200741B1

(12) United States Patent
Stanley et al.

(10) Patent No.: US 6,200,741 B1
(45) Date of Patent: Mar. 13, 2001

(54) PHOTOGRAPHIC ADDENDA

(75) Inventors: Paul L. Stanley, Harrow; John D. Goddard, Pinner, both of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/443,743

(22) Filed: Nov. 19, 1999

(30) Foreign Application Priority Data

Dec. 31, 1998 (GB) ..... 9828867

(51) Int. Cl.[7] ..... G03C 1/08

(52) U.S. Cl. ..... 430/543; 430/551; 430/372; 430/546; 430/557

(58) Field of Search ..... 430/543, 546, 430/551, 372, 557

(56) References Cited

U.S. PATENT DOCUMENTS

| | | |
|---|---|---|
| 4,727,015 | 2/1988 | Moore . |
| 4,840,877 | 6/1989 | Abe et al. . |
| 4,898,811 | 2/1990 | Wolff et al. . |
| 4,973,535 | 11/1990 | Merkel et al. . |
| 5,120,636 | 6/1992 | Takahashi et al. . |
| 5,382,500 | 1/1995 | Sugita et al. . |

FOREIGN PATENT DOCUMENTS

| | | |
|---|---|---|
| 0 510 576 | 4/1992 | (EP) . |

OTHER PUBLICATIONS

Japan 07209839—Abstract.

*Primary Examiner*—Geraldine Letscher
(74) *Attorney, Agent, or Firm*—Arthur E. Kluegel

(57) ABSTRACT

The present invention provides a photographic element comprising a support bearing a light-sensitive silver halide emulsion layer in association with an image dye-forming coupler and having associated therewith a compound of general formula $$R_1\{Y-(CF_2)_n-R_2\}_x \quad (I)$$

wherein

R1 is an unsubstituted or substituted alkyl group, aryl group or 5–10 membered heterocyclic ring group containing one or more heteroatoms selected from N, O and S;

each R2 is independently selected from hydrogen, halogen, and substituted or unsubstituted alkyl, aryl, alkyl- or aryl-sulfamoyl, alkyl- or aryl-sulfonamido, alkyl- or aryl-carbamoyl, alkyl- or aryl-carbonamido, alkenyloxy or 5–10 membered heterocyclic ring group containing one or more heteroatoms selected from N, O and S;

each Y is independently selected from the groups consisting of —NHSO2 and —SO2NH; wherein the hydrogen therein has a pKa value of less than 9;

n is an integer from 1 to 20;

x is an integer from 1 to 6 and wherein the compound is ballasted.

The addenda of formula (I) can significantly increase the image dye yield and improve robustness to process pH variation, without adverse effects on coupler or dye stability, dye hue and/or speed, in a simple, cost effective way.

22 Claims, 1 Drawing Sheet

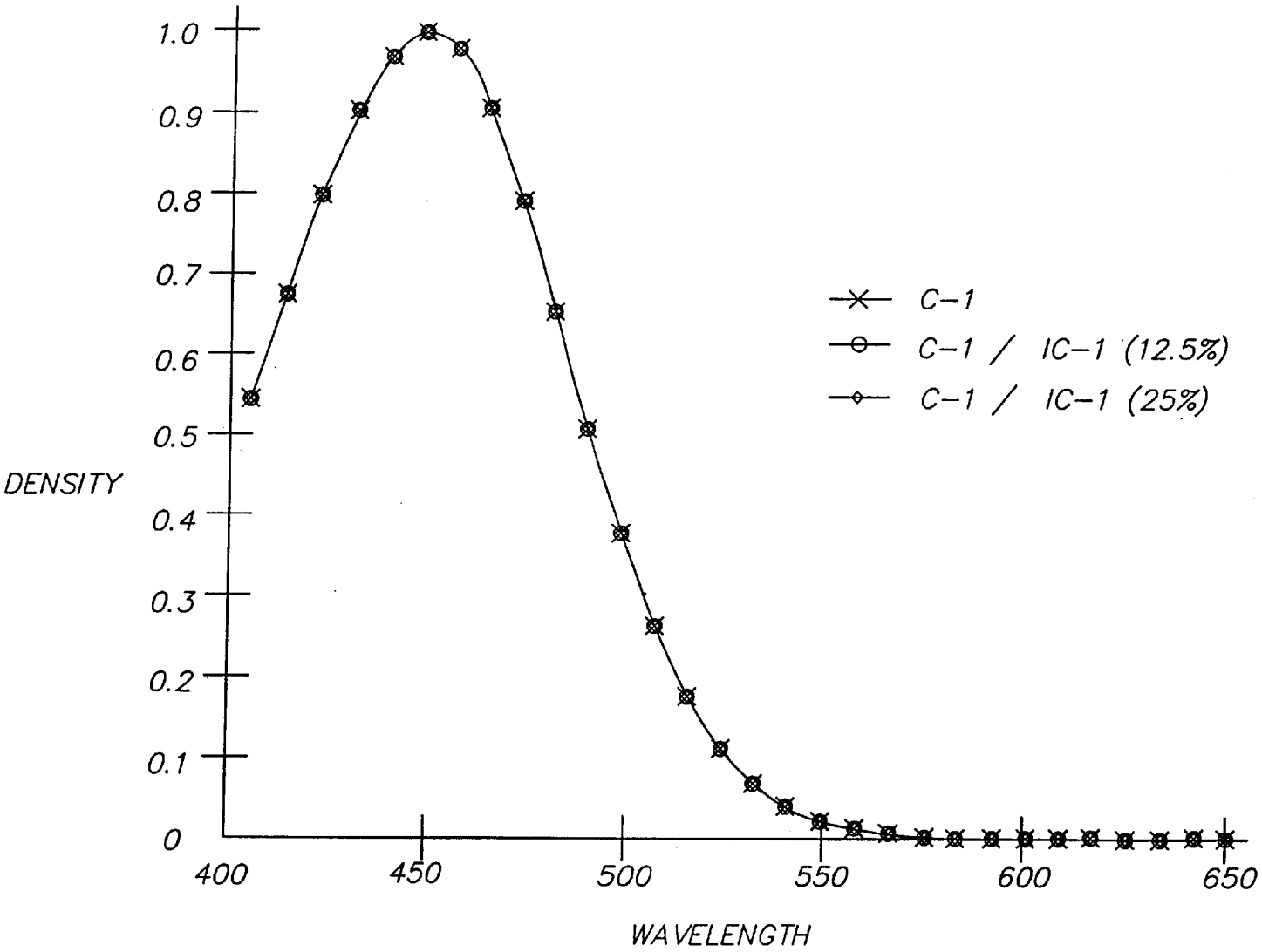
C-1
C-1 / IC-1 (12.5%)
C-1 / IC-1 (25%)
DENSITY
1.0
0.9
0.8
0.7
0.6
0.5
0.4
0.3
0.2
0.1
0
400
450
500
550
600
650
WAVELENGTH

PHOTOGRAPHIC ADDENDA

FIELD OF THE INVENTION

This invention relates to the fields of conventional silver halide and thermally processed colour photography. More specifically the invention relates to the use of certain addenda in such systems to improve the photographic performance of image dye-forming couplers for use with emulsions thereof.

BACKGROUND OF THE INVENTION

Conventional silver halide colour photographic elements contain a number of silver halide emulsion layers. These layers are spectrally sensitized to particular colours of light and have associated therewith image dye-forming coupler compounds, hereinafter referred to as 'couplers', capable of forming image dyes upon contact with oxidised developer. In order to obtain an image in a desirable processing time, it is necessary that the coupler have sufficient activity to form the image in the allowed processing time. This requires a certain minimum range of reactivity. When the image is ultimately comprised of more than one dye, it is further necessary that the reactivity of the couplers of different colours be balanced so as to enable a proper neutral colour when needed.

When dye images are formed in silver halide photographic materials from the combination of oxidised developer and incorporated image dye-forming couplers, certain stringent demands are made of the couplers. For instance, the couplers must yield dyes which absorb in the correct region of the visible spectrum and which are resistant to fading by light, heat and humidity. The couplers must be active, have a low propensity to form fog, be easily dispersible and must themselves be resistant to the deleterious actions of light, heat and humidity. It is also important that the photographic performance of the couplers is resistant to changes in processing conditions, such as changes in the pH of the developing solution.

In the design of a coupler, it is the aim of the photographic chemist to incorporate various groups into the coupler structure to achieve, or partially achieve, the various desirable properties outlined above. However, it is well known in the art of coupler chemistry that when a functionality is incorporated into a molecule to achieve one of the aforementioned desirable properties (such as high activity), quite often one of the other desirable properties (such as high dye light stability or dye hue) is adversely affected. The structure of a coupler is therefore always a compromise. Furthermore, couplers which contain many functionalities suffer from the disadvantage that they are difficult and therefore expensive to prepare.

For example, hydrophilic substituents on couplers have been used effectively to improve the activity of the coupler through lowering the apparent dispersion pKa (known as pH1/2) of the coupler and through increasing the hydrophilicity of the coupler/coupler solvent particles.

However, such substituents have adverse effects on other aspects of the coupler such as ease of synthesis, cost and degradation in light stability and shift in dye hue of the resulting dye. In addition, incorporation of solubilizing/activating groups into the coupler can lead to an increased tendency for the image dye and/or the coupler to 'wash out' from the element during the process.

The use of addenda to improve specific properties of the image coupler or the resultant photographic dye formed on development is well established. These addenda may be added in the form of a co-dispersion with the image coupler or added separately to the photographic layer either as a separate dispersion or in solution. For example it is common practice to enhance stability of photographic dyes to light by the use of addenda such as poly-alkoxy benzenes or substituted phenols or bis-phenols. In U.S. Pat. No. 4,727,015 the incorporation of organosilanes in a photographic layer containing a dye-forming coupler is shown to improve the density and contrast of dye images produced after exposure and processing. U.S. Pat. No. 4,840,877 discloses the use of ballasted carboxylic acids with magenta dye-forming couplers to improve coupler/silver interactions which may lead to speed losses and to their use to improve the efficiency of dye formation. U.S. Pat. No. 5,382,500 discloses sulfonamides in green sensitive layers giving materials with improved keeping and process pH sensitivity. JP 07209839 describes sulfonamides as developing accelerators in heat developable systems in combination with dye releasing reductants. U.S. Pat. No. 4,973,535 and EP 0 510 576 disclose respectively the use of sulfonamide solvents to alter the hue of couplers and sulfoxides to lessen continued coupling in magenta couplers. U.S. Pat. No. 5,120,636 claims a combination of magenta coupler, sulfonamide and bis-phenol for improving light fastness and U.S. Pat. No. 4,898,811 describes sulfonylphenols as oil formers.

Problem to be Solved by the Invention

The problem is to provide a means for improving photographic performance of silver halide elements, and in particular improving dye yield and robustness to process pH variation, resulting in higher and more consistent density.

SUMMARY OF THE INVENTION

According to the present invention, there is provided a photographic element comprising a support bearing a light-sensitive silver halide emulsion layer in association with an image dye-forming coupler and having associated therewith a compound of general formula $$R_1\{Y-(CF_2)_n-R_2\}_x \qquad (I)$$

wherein

R1 is an unsubstituted or substituted alkyl group, aryl group or 5–10 membered heterocyclic ring group containing one or more heteroatoms selected from N, O and S;

each R2 is independently selected from hydrogen, halogen, and substituted or unsubstituted alkyl, aryl, alkyl-or aryl-sulfamoyl,alkyl- or aryl-sulfonamido, alkyl- or aryl-carbamoyl, alkyl-or aryl-carbonamido, alkenyloxy or 5–10 membered heterocyclic ring group containing one or more heteroatoms selected from N, O and S;

each Y is independently selected from the groups consisting of —NHSO2 and —SO2NH; wherein the hydrogen therein has a pKa value of less than 9;

n is an integer from 1 to 20;

x is an integer from 1 to 6 and wherein the compound of formula (I) is ballasted.

In another embodiment there is provided a multicolour photographic element comprising a support bearing a cyan image-dye-forming unit comprising a red-sensitive silver halide emulsion layer and a cyan dye-forming coupler; a magenta image-dye-forming unit comprising at least one green-sensitive silver halide emulsion layer and a magenta dye-forming coupler; a yellow image-dye-forming unit comprising at least one blue-sensitive silver halide emulsion layer and a yellow dye-forming coupler characterised in that it also contains associated therewith a compound of general formula (I) as hereinbefore defined.

In a further embodiment there is provided a process of forming a photographic image which comprises imagewise exposing a photographic element comprising a support bearing a silver halide emulsion layer and processing it with an alkaline developer solution characterised in that it is developed in the presence of a compound of formula (I) as hereinbefore defined.

Advantageous Effect of the Invention

The invention provides a means for improving photographic performance of silver halide elements, and in particular improving dye yield and robustness to process pH variation, resulting in higher and more consistent density.

BRIEF DESCRIPTION OF THE DRAWINGS

FIG. 1 show the visible absorption curves of density v. wavelength for an image coupler alone and in combination with an addendum of formula(I), added at two different levels

DETAILED DESCRIPTION OF THE INVENTION

The invention is generally as described in the summary of the Invention. R1 is selected from an unsubstituted or substituted alkyl, aryl group or 5–10 membered heterocyclic ring containing one or more heteroatoms selected from N, O and S. Preferably R1 is an aryl group, such as a phenyl group or a naphthyl group; an alkyl group, such as an alkylene or cyclohexyl group; or a heterocyclic group, such as a pyridyl, thiazolyl or isoquinolinyl group. Any of these groups for R1 may preferably be substituted, for example, with an alkyl- or aryl-sulfamoyl, alkyl- or aryl-sulfonamido, alkyl- or aryl-sulfonyloxy, alkyl-or aryl-carbamoyl, alkyl-or aryl-carbonamido or alkyl-or aryl-oxysulfonyl group.

Each R2 is independently hydrogen, halogen, or an unsubstituted or substituted alkyl, aryl, alkyl-or aryl-sulfamoyl, alkyl-or aryl-sulfonamido, alkyl- or aryl-carbamoyl alkyl-or aryl-carbonamido, alkenyloxy or 5–10 membered heterocyclic ring group containing one or more heteroatoms selected from N, O and S. Preferably each R2 is independently hydrogen, halogen, or an aryl-sulfamoyl, alkyl-sulfonamido, alkyl-carbamoyl, alkenyloxy, cycloalkyl or alkyl group, more preferably hydrogen, fluorine, bromine or trifluoromethyl.

n is an integer from 1 to 20, conveniently 1 to 8, especially 1 and x is an integer from 1 to 6, i.e. if R1 is a phenyl ring then it can be substituted in every position, but preferably x is 1 or 2.

Embodiments of the invention containing the addenda of formula (I) of the present invention when incorporated together with couplers in photographic silver halide materials may significantly increase the image dye yield formed during photographic processing resulting in higher density and/or gamma, have no substantial adverse effects on coupler or dye stability, and do not necessarily have the same effect as including the compound as a substituent of the coupler.

As used herein and throughout the specification the term alkyl refers to an unsaturated or saturated straight or branched chain alkyl group (including alkenyl and alkylene) having 1–20 atoms and includes cycloalkyl having 3–8 carbon atoms. The term aryl includes aralkyl (and specifically fused aryl within its scope). The term heterocyclic specifically includes fused heterocyclic within its scope.

To control the migration of various components, it is necessary to include a high molecular weight or polymeric backbone containing hydrophobic or "ballast" group in the coupler and addenda compound, the size and nature of which will depend on the bulk of the unballasted compound and the presence of other substituents thereon. It is essential that the addenda compound be ballasted. For the addenda compound, either R1 and/or R2 (the combined effect of R1 and all R2 groups) contains a ballast group. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Unless otherwise specifically stated, substituent groups usable on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned.

Suitably, the group may be halogen or may be bonded to the remainder of the molecule by an atom of carbon, silicon, oxygen, nitrogen, phosphorus, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxy-ethoxy, sec-butoxy, hexyloxy, 2-ethylhexyloxy, tetra-decyloxy, 2-(2,4-di-t-pentylphenoxy)ethoxy, and 2-do-decyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentyl-phenoxy)butyramido, alpha-(3-pentadecylphenoxy)-hexanamido, alpha-(4-hydroxy-3-t-butylphenoxy-tetradecanamido, 2-oxo-pyrrolidin-1-yl, 2-oxo-5-tetra-decylpyrrolidin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, exycarbonylamino, phenoxycarbonyl-amino, benzyloxycarbonylamino, hexadecyloxycarbonyl-amino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-di-octyl-N'-ethylureido, N-phenylureido, N,N-diphenyl-ureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonarnido, N,N-di-propylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxybutyl]sulfamoyl, N-methyl-N-tetradecylsulfamoyl, and N-dodecylsulfamoyl; carbamoyl, such as N-methylcarbamoyl, N,N-dibutyl-carbamoyl, N-octadecylcarbamoyl, N-[4-(2,4-di-t-pentylphenoxy) butyl]carbamoyl, N-methyl-N-tetra-decylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxy-carbonyl, butoxycarbonyl, tetradecyloxycarbonyl, ethoxycarbonyl, benzyloxycarbonyl, 3-pentadecyloxy-carbonyl, and dodecyloxycarbonyl; sulfonyl, such as methoxysulfonyl, octyloxysulfonyl, tetradecyloxy-sulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenyl-sulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecyl-sulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octyl-phenylthio, and p-tolylthio; acyloxy, such as acetyloxy, benzoyloxy, octadecanoyloxy, p-dodecylamidobenzoyloxy, N-phenylcarbamoyloxy, N-ethyl-carbamoyloxy, and cyclohexylcarbonyloxy; amine, such as phenylanilino, 2-chloroanilino, diethylamine, dodecylamine; imido, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzo-thiazolyl; quaternary ammonium, such as triethyl-ammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups and groups which adsorb to silver halide. Generally, the above groups and substituents thereof may include those having up to 48 carbon atoms, typically 1 to 36 carbon atoms and usually less than 24 carbon atoms, but greater numbers are possible depending on the particular substituents selected.

The following structures illustrate some specific examples of the compounds of the invention:

(IC-1)

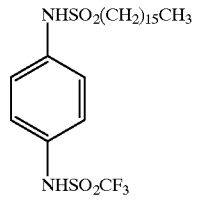

(IC-2)

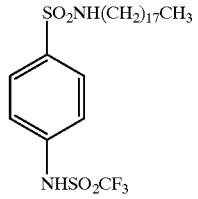

(IC-3)

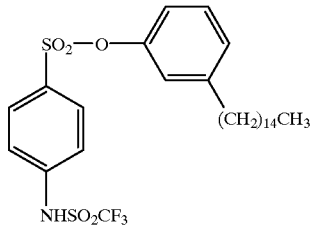

(IC-4)

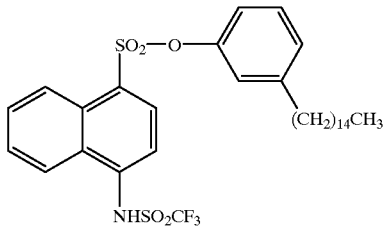

(IC-5)

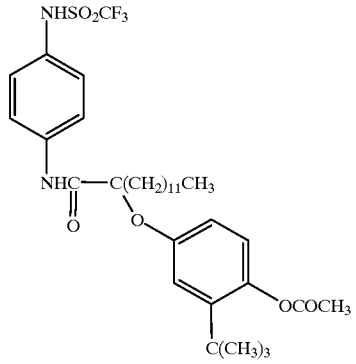

-continued
(IC-6)
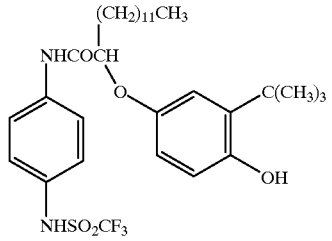
(IC-7)
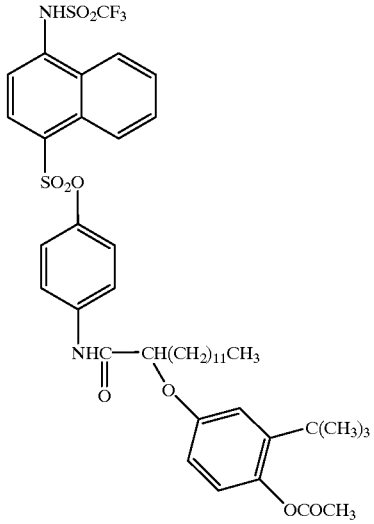
(IC-8)
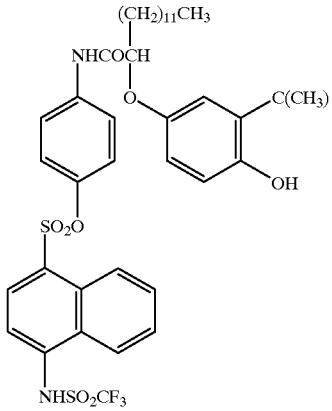
(IC-9)
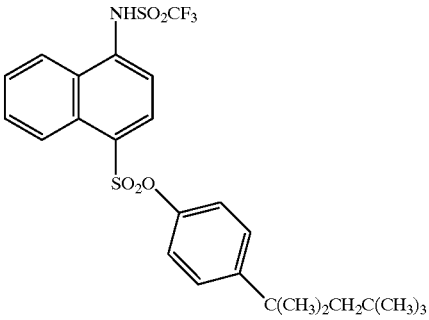
-continued
(IC-10)
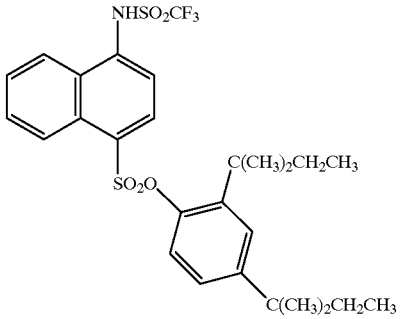
(IC-11)
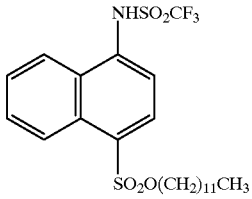
(IC-12)
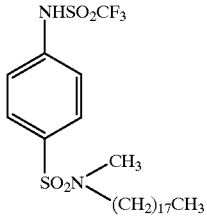
(IC-13)
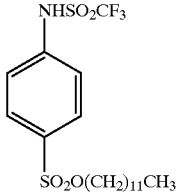
(IC-14)
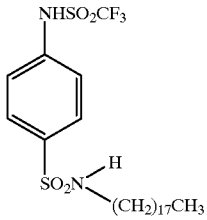
(IC-15)
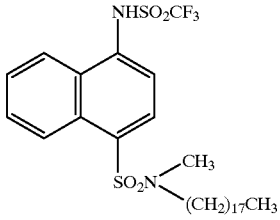

-continued
(IC-16)
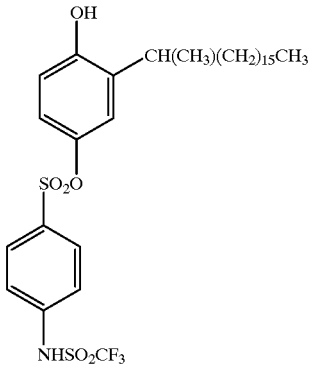
(IC-17)
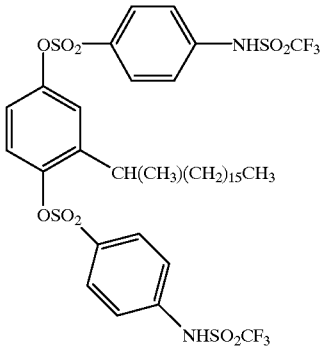
(IC-18)
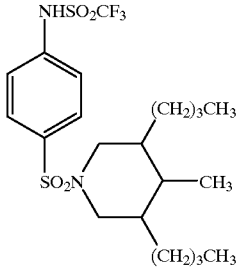
(IC-19)
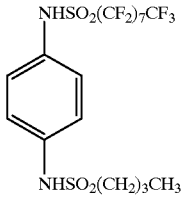
(IC-20)
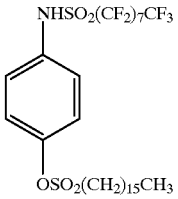
(IC-21)
-continued
(IC-22)
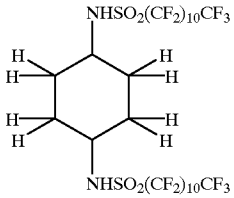
(IC-23)
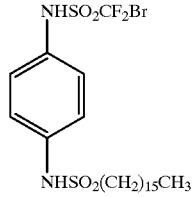
(IC-24)
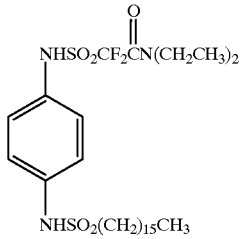
(IC-25)
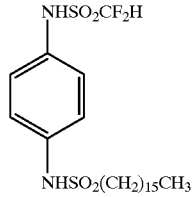
(IC-26)
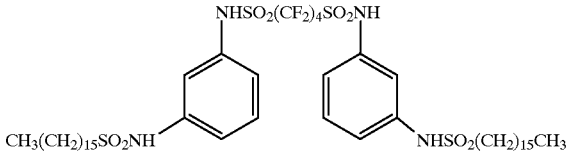
(IC-27)
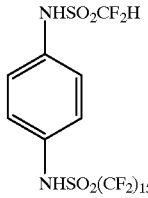
(IC-28)
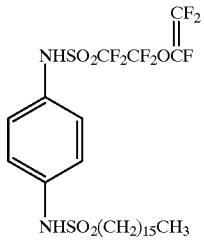

-continued (IC-29)

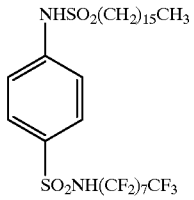

(IC-30)

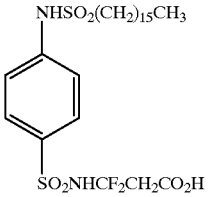

(IC-31)

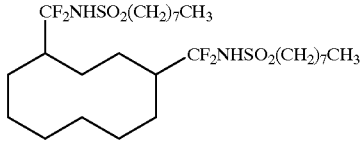

(IC-32)

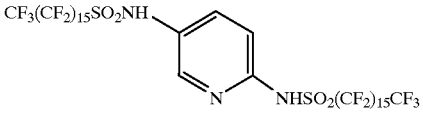

(IC-33)

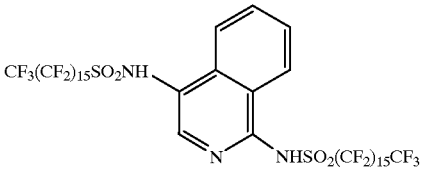

(IC-34)

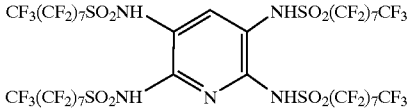

(IC-35)

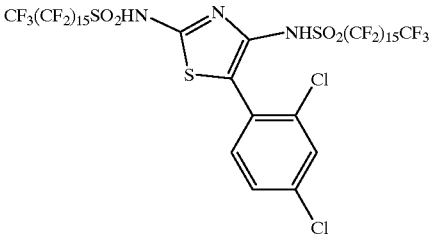

(IC-36)

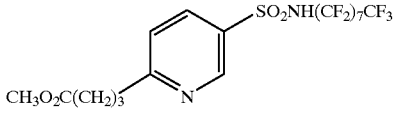

The couplers and the addenda of the invention can be used in any of the ways and in any of the combinations known in the art. Typically, they are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidised color developing agent. Thus, as used herein, the term "associated" signifies that the compound is in the silver halide emulsion layer or in an adjacent location where, during processing, it is capable of reacting with silver halide development products.

The addendum compound of formula (I) may be incorporated as part of the coupler dispersion or as a separate dispersion, preferably coated within the same photographic layer as the coupler which it affects. The couplers used in the invention are usually utilised by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethyl-hexyl) sulfoxide), sulfonamides (e.g. N,N-dibutyl-p-toluenesulfonamide) or hydrocarbons (e.g. dodecylbenzene).

Additional coupler solvents and auxiliary solvents are noted in Research Disclosure, December 1989, Item 308119, p 993.

Useful coupler:coupler solvent weight ratios range from about 1:0.1 to 1:8.0, with 1:0.2 to 1:4.0 being preferred. The level of addendum relative to the coupler weight ratios may be from 0.01:1 to 10:1, preferably from 0.1:1 to 2:1, more preferably from 0.1:1 to 0.6:1.

The pKa of the fluoroalkyl-sulfonamide or fluroalkyl-sulfamoyl NH must be such that it is substantially ionised at the pH of the developing solution, i.e. having a pKa value of less than 9. The compound of formula (I) may be used in association with any magenta, yellow or cyan coupler but the effects are best seen with those couplers that have a relatively high dispersion pKa value of less than 10. For example yellow couplers, such as alkyl dicarbonyl methylene compounds, including high dye yield couplers, as described in U.S. Pat. Nos. 4,840,884, 5,447,819 and 5,457,004, magenta couplers, such as pyrazolones and pyrazoloazoles and cyan couplers, such as phenols, naphthols and heterocyclic compounds may be used.

The photographic element may be a single colour element or a multicolour element. Multicolour elements contain image-dye-forming units sensitive to each of the three primary regions of the visible range of the electromagnetic spectrum. Each unit may comprise a single emulsion layer or a plurality of emulsion layers sensitive to a given region of the spectrum. The layers of the element, including the layers of the image-dye-forming units, may be arranged in various orders as known in the art. In an alternative format, the emulsions sensitive to each of the three primary regions of the spectrum may be disposed as a single segmented layer.

A typical multicolour photographic element comprises a support bearing a cyan image-dye-forming unit comprising a red-sensitive silver halide emulsion layer and a cyan dye-forming coupler; a magenta image-dye-forming unit-comprising at least one green-sensitive silver halide emulsion layer and a magenta dye-forming coupler; a yellow image-dye-forming unit comprising at least one blue-sensitive silver halide emulsion layer and a yellow dye-forming coupler; in association with a compound of fomula (I). The element may contain additional layers, such for example as filter layers, interlayers, overcoat layers and subbing layers.

Photographic elements of the present invention may also usefully include a magnetic recording material as described in Research Disclosure, Item 34390, November 1992, published by Kenneth Mason Publications, Ltd., Dudley Annex, 12a North Street, Emsworth, Hampshire P010 7DQ, ENGLAND" and as described in Hatsumi Kyoukai Koukai Gihou No. 94-6023, published Mar. 15, 1994, available from the Japanese Patent Office, the contents of both of these being incorporated herein by reference. They may also include a transparent magnetic recording layer such as a layer containing magnetic particles on the underside of a transparent support as described in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical. When it is desired to employ the element in a small film format, Research Disclosure, June 1994, Item 36230, available as described above, provides suitable embodiments.

In the following discussion of suitable materials for use in the emulsions and elements of this invention, reference will be made to the 'Research Disclosure', September 1994, item 36544, available as described above, which will be identified hereafter by the term "Research Disclosure". The contents of the Research Disclosure, including the patents and publications referenced therein, are incorporated herein by reference and the Sections hereafter referred to are Sections of the Research Disclosure.

The silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 Research Disclosure, Item No. 36544 referenced above, is updated in the September 1996 Research Disclosure, Item No. 38957. Certain desirable photographic elements and processing steps, including those useful in conjunction with color reflective prints, are described in Research Disclosure, Item 37038, February 1995.

Photographically useful coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, 5 chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers included in the element may be couplers that form cyan dyes upon reaction with oxidized color developing agents such as are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EP-A-0 250 201; EP-A-0 271 323; EP-A-0 295 632; EP-A-0 307 927; EP-A-0 333 185; EP-A-0 378 898; EP-A-0 389 817; EP-A-0 487 111; EP-A-0 488 248; EP-A-0 539 034; EP-A-0 545 300; EP-A-0 556 700; EP-A-0 556777; EP-A-0 556 858; EP-A-0 569 979; EP-A-0 608 133; EP-A-0 636 936; EP-A-0 651 286; EP-A-0 690344; German OLS 4,026,903; German OLS 3,624,777. and German OLS 3,823,049. Typically such couplers are phenols, naphthols, or-pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp.126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058;

5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EP-A-0 257 854; EP-A-0 284 240; EP-A-0 341204; EP-A-0 347 235; EP-A-0 365 252; EP-A-0 422 595; EP-A-0 428 899; EP-A-0 428 902; EP-A-0 459 331; EP-A-0 467 327; EP-A-0 476 949; EP-A-0 487 081; EP-A-0 489 333; EP-A-0 512 304; EP-A-0 515 128; EP-A-0 534 703; EP-A-0 554 778; EP-A-0 558 145; EP-A-0 571 959; EP-A-0 583 832; EP-A-0 583 834; EP-A-0 584 793; EP-A-0 602 748; EP-A-0 602749; EP-A-0 605 918; EP-A-0 622 672; EP-A-0 622 673; EP-A-0 629 912; EP-A-0 646 841, EP-A-0 656 561; EP-A-0 660 177; EP-A-0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912, 265; and German OLS4008067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EP-A-0 327 976; EP-A-0 296 793; EP-A-0 365 282; EP-A-0 379 309; EP-A-0 415 375; EP-A-0 437 818; EP-A-0 447 969; EP-A-0 542 463; EP-A-0 568 037; EP-A-0 568 196; EP-A-0 568 777; EP-A-0 570 006; EP-A-0 573 761; EP-A-0 608 956; EP-A-0 608 957; and EP-A-0 628 865. Such couplers are typically open chain ketomethylene compounds.

Couplers that form colorless products upon reaction with oxidized color developing agent are described in such representative patents as: UK. 861,138; U.S. Pat. Nos. 3,632, 345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,23 1; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543, 323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercapto-tetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulae:

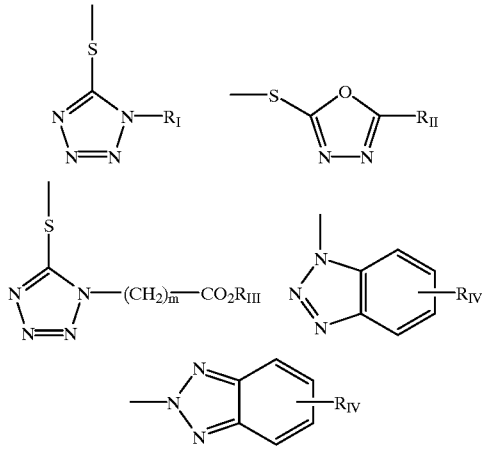

wherein RI is selected from the group consisting of straight and branched alkyls of from 1 to about 8 carbon atoms, benzyl, phenyl, and alkoxy groups and such groups containing none, one or more than one such substituent; RII is selected from RI and —SRI; RIII is a straight or branched alkyl group of from 1 to about 5 carbon atoms and m is from 1 to 3; and RIV is selected from the group consisting of hydrogen, halogens and alkoxy, phenyl and carbonamido groups, —COORV and —NHCOORV wherein RV is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. No. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulae:

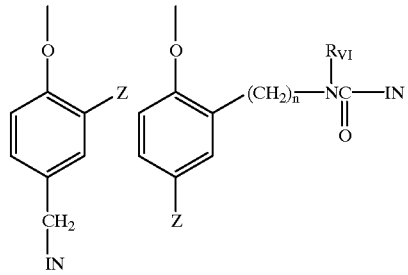

wherein IN is the inhibitor moiety, Z is selected from the group consisting of nitro, cyano, alkylsulfonyl; sulfamoyl (—SO2NR2); and sulfonamido (—NRSO2R) groups; n is 0 or 1; and RVI is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

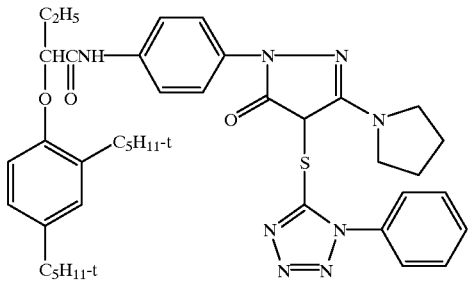

D2

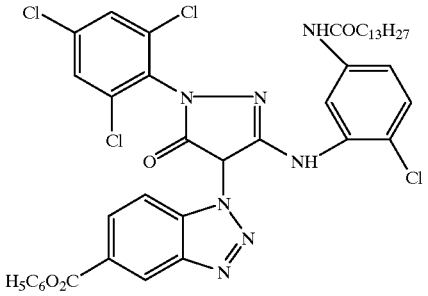

-continued
D3
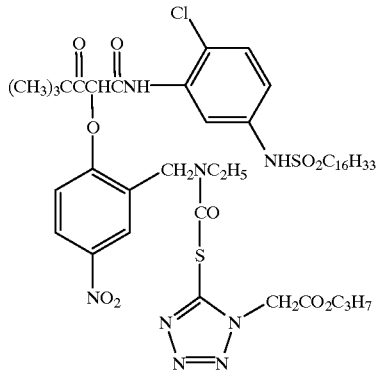
D4
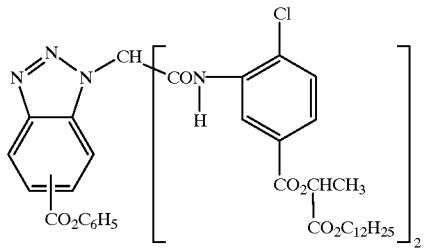
D5
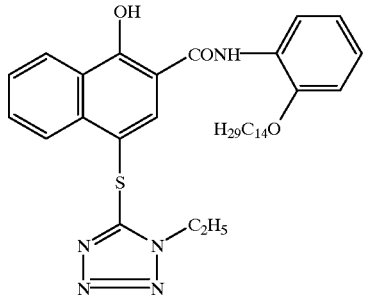
D6
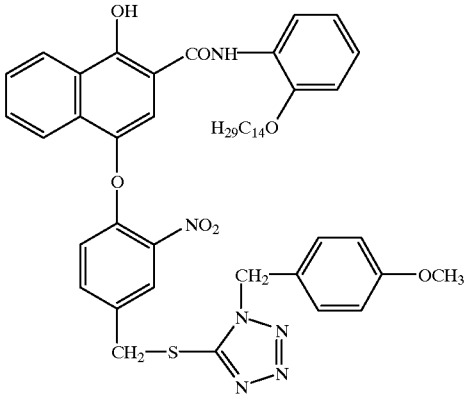
-continued
D7
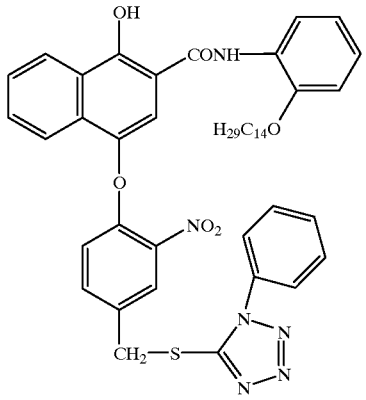
D8
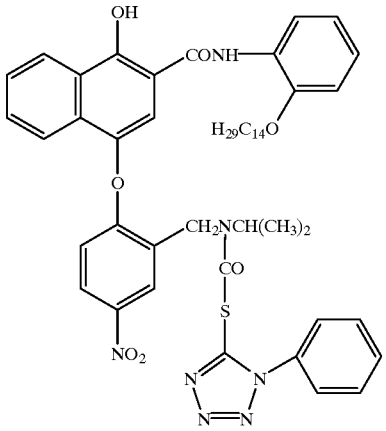
D9
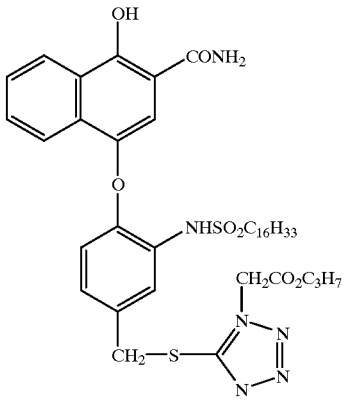

-continued

D10

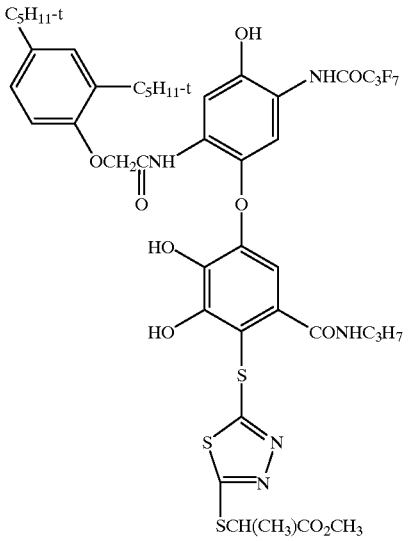

D11

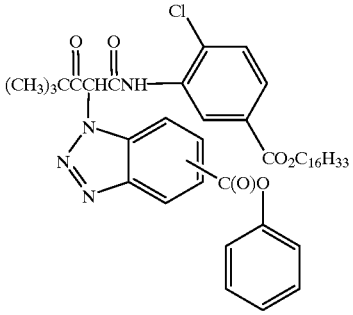

D12

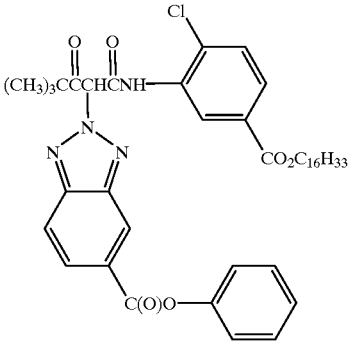

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidise the color developing agent. Oxidised color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing.

To provide a positive (or reversal) image, the color development step is preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as the Kodak E-6 process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

The colour developing agent may be selected from p-phenylenediamines; typically the agent may be selected from:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)-aniline sulfate, 4-amino-3-(2-inethanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The invention will now be described with reference to the following examples but is in no way to be interpreted as limited thereto.

EXAMPLE 1

Preparation of Inventive Compound (IC-1)

The following preparation of compound (IC-1) is illustrative for the compounds of this invention. All the starting materials are commercially available.

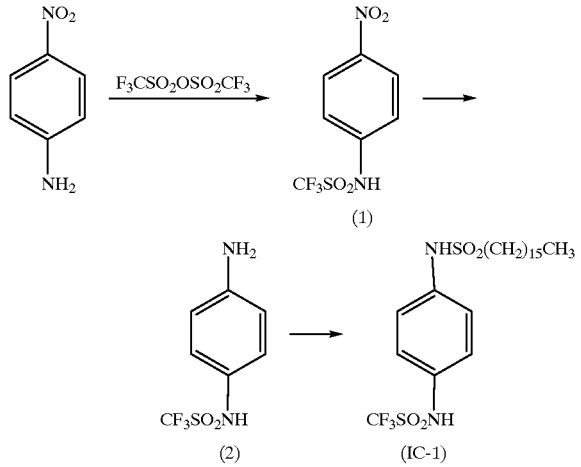

Intermediate (1)

4-Nitroaniline (10.0 g, 0.072 mol) was dissolved in dry clichloromethane (200 ml) under an atmosphere of nitrogen and trifluoromethanesulfonic anhydride (20.3 g, 0.072 mol) added dropwise. The reaction mixture was stirred overnight. TLC (silica plate; eluant: ethyl acetate) indicated the presence of residual aniline so a further quantity of the anhydride (2.03 g, 0.007 mol) was added and stirred overnight. More anhydride (1.01 g, 0.0036 mol) was added and stirring continued for 1h. The mixture was extracted several times with water (total 600 ml) and then with dilute hydrochloric acid (0.05M; 600 ml). The organic layer was dried (MgSO4) and the solvent removed under reduced pressure to give a brown oil.

The product was dissolved in petrol and filtered (to remove residual nitroaniline) and isolated as a brown oil which slowly crystallized by rotary evaporation. Nmr indicated the presence of a small amount of residual nitroaniline but the compound was used without further purification. Yield=16.2 g (83%).

Intermediate (2)

Compound (1) (11.6 g, 0.056 mol) was dissolved in tetrahydrofuran (500 ml) with 10% palladium on carbon catalyst (0.4 g). The mixture was reduced under 34 atmospheres of hydrogen by stirring overnight. The catalyst was filtered off and the solvent removed under reduced pressure to yield the product as a yellow oil. Yield=9.9 g (quantitative).

Inventive Compound (IC-1)

Compound (2) was dissolved in a mixture of tetrahydrofuran (120 ml) and pyridine (30 ml). Hexadecylsulfonyl chloride (18.1 g, 0.056 mol) was added and the mixture stirred overnight. The solvent was removed under reduced pressure, the residue redissolved ethyl acetate (800 ml) and washed with dilute hydrochloric acid until the washings remained acid. The mixture was dried (MgSO4) and evaporated to dryness under reduced pressure. The residue was purified by chromatography on a column of silica using petrol:ethyl acetate (2:1) as eluant. Evaporation of the solvent afforded the product as cream coloured solid. Yield=3.2 g (12%).

EXAMPLE 2

Photographic Evaluation of Inventive Compound (IC-1)

A compound of the present invention IC-1 was co-dispersed with the yellow image coupler C-1

C-1

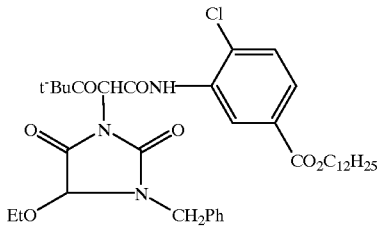

in coupler solvent and incorporated into single layer photographic coatings containing a blue-sensitive silver bromoiodide emulsion, on a transparent support, according to the following coating diagram:

| | | |
|---|---|---|
| Gel Supercoat | Gelatin | 1.00 g/m2 |
| Emulsion Layer | Silver bromoiodide | 0.81 g/m2 |
| | Coupler C-1 | 1.348 g/m2 |
| | Inventive Compound IC-1 | X g/m2 |
| | Gelatin | 2.42 g/m2 |
| | Bis(vinylsulfonyl)methane (hardener) | 0.06 g/m2 |
| Support | Cellulose acetate | |

The inventive compound IC-1 was codispersed with the image coupler C-1 at 12.5% and 25% by weight relative to the image coupler, resulting in a laydown of IC-1 in the coating of X=0.169 g/m2 and 0.337 g/m2 respectively.

Aqueous dispersions of the coupler were prepared by methods known in the art. The yellow dye-forming coupler dispersions contained 6% by weight of gelatin, 9% by weight of coupler and a 1.0:0.125:0.5:1.5 or a 1.0:0.25:0.5:1.5 weight ratio of coupler to inventive compound to di-n-butyl phthalate coupler solvent to cyclohexanone auxiliary solvent. Control dispersions in which no inventive compound was incorporated were prepared for comparison purposes. The auxiliary solvent was included to aid in dispersion preparation and was removed by washing the dispersion for 6h at 4° C. and pH 6.0.

Sensitometric Testing

The experimental photographic coatings prepared in this way were slit and chopped into 30 cm×35 mm test strips. After hardening the strips were exposed (1.0s) through a 0–4.0 neutral density step wedge (0.2 ND step increments) and Daylight V, Wratten 35+38A filters and 0.3 ND filter then processed through a standard C-41 process as described in the British Journal of Photography Annual (1988) 196–198 using the following steps and process times:

| | |
|---|---|
| Developer | 2.5 minutes |
| Bleach | 4.0 minutes |
| Wash | 2.0 minutes |
| Fix | 4.0 minutes |
| Wash | 2.0 minutes |

For each test strip, Status M densities were measured as a function of exposure using a spectral array automatic transmission densitometer. Measurements of sensitometric parameters—maximum density (Dmax), contrast (γ) and photographic speed (KIT)—were obtained from plots of density vs. log exposure (DlogE curves).

In addition to the above standard conditions, separate strips of each coating were also developed in a competing process employing the same process steps as above but using a developer modified by the addition of 5.0 g/l citrazinic acid (CZA) and adjusted to pH 10.0 by the addition of sodium carbonate. The ratio of contrast in the competing process to contrast in the standard process (γCZA/γSTD) is quoted as an indication of in-film reactivity of the coupler.

The sensitometric results for these photographic coatings are shown in Table 1.

TABLE 1

| Coupler Addendum | Dmax | γ | γCZA/γSTD | KIT spd |
|---|---|---|---|---|
| C-1 | 2.09 | 1.54 | 0.46 | 187 |
| C-1/IC-1 (12.5%) | 2.22 | 1.78 | 0.51 | 183 |
| C-1/IC-1 (25.0%) | 2.30 | 1.76 | 0.50 | 184 |

It can clearly be seen that incorporation of the compound of the invention IC-1 provides a boost in Dmax and contrast (γ) and in in-film reactivity as measured by γCZA/γSTD with little effect on photographic speed (KIT spd).

From FIG. 1 it can be seen that addition of the addendum IC-1 has no noticeable effect on the dye hue generated by the image coupler C-1 in-film at either 12.5% or 25%.

EXAMPLE 3

Photographic Evaluation of Inventive Compounds (IC-1 and IC-2)

Inventive compounds IC-1 and IC-2 have also been evaluated with high dye yield image coupler C-2

C-2

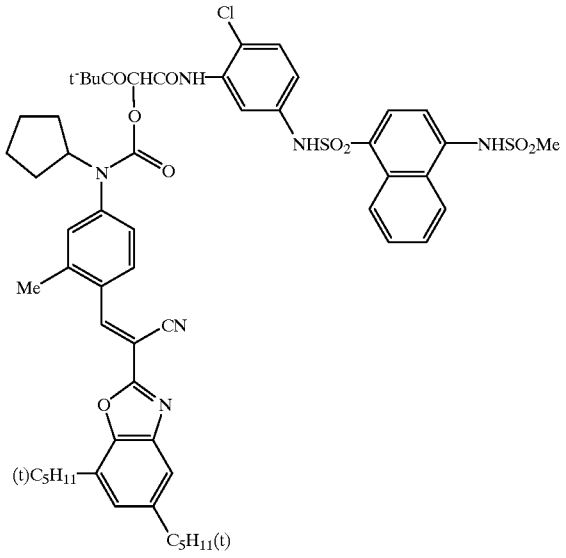

in single layer photographic coatings containing a blue-sensitised tabular bromoiodide emulsion prepared according to the following coating diagram:

| | | |
|---|---|---|
| Gel supercoat | Gelatin | 1.08 g/m2 |
| | Bis(vinylsulfonyl)methane (hardener) | 0.124 g/m2 |
| Emulsion layer | Silver bromoiodide | 0.646 g/m2 |
| | Coupler C-2 | 0.29 g/m2 |
| | Compound IC-1 or IC-2 | 0.145 g/m2 |
| | Gelatin | 2.69 g/m2 |
| Antihalation layer | Black colloidal silver | 0.344 g/m2 |
| | Gelatin | 2.44 g/m2 |
| Support | Cellulose Acetate | |

The inventive compound IC-1 or IC-2 was codispersed with the image coupler C-2 at 50% by weight relative to the image coupler, resulting in a laydown of IC-1 or IC-2 in the coating of 0.145 g/m$^2$.

Aqueous dispersions of the coupler were prepared by methods known in the art. The yellow dye-forming coupler dispersions contained 6% by weight of gelatin, 3% by weight of coupler and a 1.0:0.5:0.5:0.5:3.0 weight ratio of coupler to inventive compound to 1,4-cyclohexanediylbis (methylene) 2-ethylhexanoate (CAS Reg. No. 53148-32-6) coupler solvent to 2-phenylethyl benzoate coupler solvent to ethyl acetate auxiliary solvent. Control dispersions in which no inventive compound was incorporated were prepared for comparison purposes. The ethyl acetate was included to aid in dispersion preparation and was removed by evaporation.

The experimental photographic coatings prepared in this way were slit and chopped into 30 cm×35 mm test strips. After hardening the strips were exposed (0.01 s) through a 0–4.0 neutral density step wedge (granularity wedge) 0.15 Inconel and Wratten 2B filter then processed through a standard C-41 process as described in the British Journal of Photography Annual (1988) 196–198 in a similar way to that described in Example 2 but with a development time of 3.25 min.

Sensitometric parameters were measured in a similar way to that described in Example 2 above. The single layer results described are based on gamma changes, which indicate a change in coupling activity. When the pH of the developer solution is changed between 9.75 through 10.05 (the optimum for the C-41 colour negative process) to 10.35, this simulates changes that might occur in the photoprocessing trade. The less the gamma changes over this range the better, as no change predicts a more robust coupling system which would yield consistent results even though the process varied. In the single layer experiments, the ratio of gamma at pH 9.75 to gamma at 10.35 is calculated. The closer this ratio is to unity the better. A high gamma at the lower pH of 9.75 is also advantageous, and is an indicator of improved coupling activity.

The evaluation results are shown in Table 2.

TABLE 2

| Coupler/ Addendum | γpH = 10.05 | γpH = 9.75 | γpH = 10.35 | γpH = 9.75/ γpH = 10.35 |
|---|---|---|---|---|
| C-2 | 0.96 | 0.52 | 1.04 | 0.50 |
| C-2/IC-1 | 1.24 | 0.73 | 1.14 | 0.64 |
| C-2/IC-2 | 1.10 | 0.70 | 1.15 | 0.61 |

It can clearly be seen that the addenda of the invention improve the low pH gamma indicating increased coupler activity and the higher ratio of gamma at pH 9.75 to gamma at pH 10.35 shows that they reduce the sensitivity to pH variability.

What we claim is:

1. A photographic element comprising a support bearing a light-sensitive silver halide emulsion layer in association with an image dye-forming coupler and having associated therewith a compound of general formula (I)

$$R_1\text{-}\{Y\text{—}(CF_2)_n\text{—}R_2\}_x$$

wherein

R1 is an unsubstituted or substituted alkyl group, aryl group or 5–10 membered heterocyclic ring group containing one or more heteroatoms selected from N, O and S;

each R2 is independently selected from hydrogen, halogen, and substituted or unsubstituted alkyl, argl, alkyl- or aryl-sulfamoyl, alkyl- or aryl-sulfonamido, alkyl- or aryl-carbamoyl, alkyl- or aryl-carbonamido, alkenyloxy or 5–10 membered heterocyclic ring group containing one or more heteroatoms selected from N, O and S;

each Y is independently selected from the groups consisting of —NHSO2 and —SO2NH; wherein the hydrogen therein has a pKa value of less than 9;

n is an integer from 1 to 20;

x is an integer from 1 to 6 and wherein the compound of formula (I) is ballasted.

2. An element as claimed in claim 1 wherein R1 is selected from phenyl, naphthyl, alkylene, cyclohexyl, pyridyl, thiazolyl and isoquinolinyl groups.

3. An element as claimed in claim 1 wherein each R2 is independently hydrogen, halogen, or an alkyl, aryl-sulfamoyl, alkyl-sulfonamido, alkyl-carbamoyl, alkenyloxy or cycloalkyl group.

4. An element as claimed in claim 3 wherein each R2 is hydrogen, fluorine, bromine or trifluoromethyl.

5. An element as claimed in claim 1 wherein n is an integer from 1 to 8.

6. An element as claimed in claim 1 wherein x is 1 or 2 and R1 is a phenyl group.

7. An element as claimed in claim 6 wherein the compound of formula (I) is (IC-1)

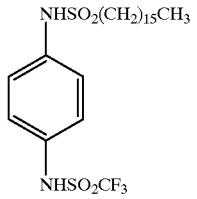

8. An element as claimed in claim 6 wherein the compound of formula (I) is (IC-2)

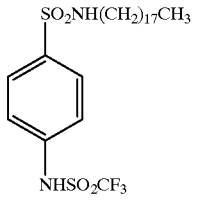

9. An element as claimed in claim 1 wherein the weight ratios of compound of formula (I) relative to the image dye-forming coupler is from 0.01:1 to 10:1.

10. An element as claimed in claim 9 wherein the weight ratios of compound of formula (I) relative to the coupler is from 0.1:1 to 2:1.

11. An element as claimed in claim 10 wherein the weight ratios of compound of formula (I) relative to the couplers from 0.1:1 to 0.6:1.

12. An element as claimed in claim 1 wherein the image dye-forming coupler is a yellow coupler.

13. An element as claimed in claim 12 wherein the yellow coupler is an alkyl dicarbonyl methylene compound.

14. An element as claimed in claim 12 wherein the yellow coupler is

C-1

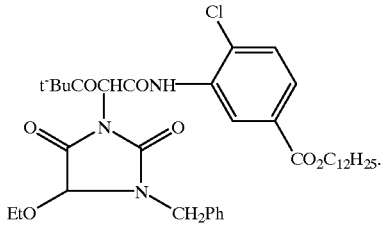

15. An element as claimed in claim 12 wherein the yellow coupler is a coupler that also releases a yellow dye upon coupling.

16. An element as claimed in claim 15 wherein the yellow coupler is

C-2

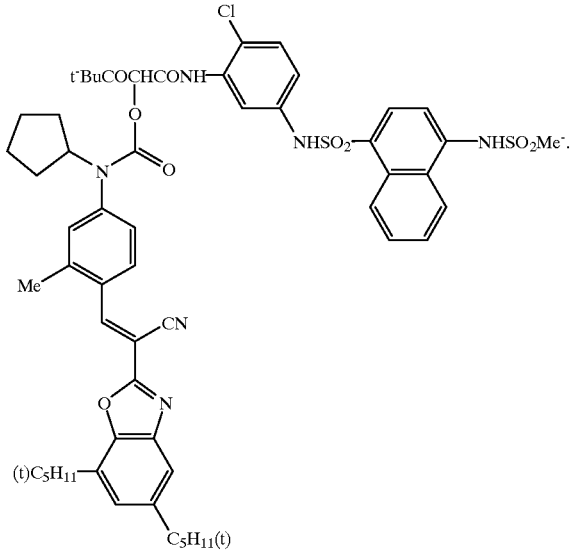

17. An element as claimed in claim 1 wherein the image dye-forming coupler is a magenta coupler.

18. An element as claimed in claim 17 wherein the magenta coupler is a pyrazolone or a pyrazolotriazole.

19. An element as claimed in claim 1 wherein the image dye-forming coupler is a cyan coupler.

20. An element as claimed in claim 19 wherein the cyan coupler is a phenol, naphthol or heterocyclic compound.

21. A multicolor photographic element comprising a support bearing a cyan image-dye-forming unit comprising a red-sensitive silver halide emulsion layer and a cyan dye-forming coupler; a magenta image-dye-forming unit comprising at least one green-sensitive silver halide emulsion layer and a magenta dye-forming coupler; a yellow image-dye-forming unit comprising at least one blue-sensitive silver halide emulsion layer and a yellow dye-forming coupler, and having associated therewith a compound of general formula (I)

$$R_1\text{—}\{Y\text{—}(CF_2)_n\text{—}R_2\}_x$$

wherein

R1 is an unsubstituted or substituted alkyl group, aryl group or 5–10 membered heterocyclic ring group containing one or more heteroatoms selected from N, O and S;

each R2 is independently selected from hydrogen, halogen, and substituted or unsubstituted alkyl, aryl, alkyl- or aryl-sulfamoyl, alkyl- or aryl-sulfonamido, alkyl- or aryl-carbamoyl, alkyl- or aryl-carbonamido, alkenyloxy or 5–10 membered heterocyclic ring group containing one or more heteroatoms selected from N, O and S;

each Y is independently selected from the groups consisting of —NHSO2 and —SO2NH; wherein the hydrogen therein has a pKa value of less than 9;

n is an integer from 1 to 20;

x is an integer from 1 to 6 and wherein the compound of formula (I) is ballasted.

22. A process of forming a photographic image which comprises imagewise exposing a photographic element comprising a support bearing a silver halide emulsion layer and processing it with an alkaline developer solution, wherein it is developed in the presence of a compound of formula (I)

$$R_1\text{—}\{Y\text{—}(CF_2)_n\text{—}R_2\}_x$$

wherein

R1 is an unsubstituted or substituted alkyl group, aryl group or 5–10 membered heterocyclic ring group containing one or more heteroatoms selected from N, O and S;

each R2 is independently selected from hydrogen, halogen, and substituted or unsubstituted alkyl, aryl, alkyl- or aryl-sulfamoyl, alkyl- or aryl-sulfonamido, alkyl- or aryl-carbamoyl, alkyl- or aryl-carbonamido, alkenyloxy or 5–10 membered heterocyclic ring group containing one or more heteroatoms selected from N, O and S;

each Y is independently selected from the groups consisting of —NHSO2 and —SO2NH; wherein the hydrogen therein has a pKa value of less than 9;

n is an integer from 1 to 20;

x is an integer from 1 to 6 and wherein the compound of formula (I) is ballasted.

* * * * *